US008409370B2

(12) United States Patent
Takashima et al.

(10) Patent No.: US 8,409,370 B2
(45) Date of Patent: Apr. 2, 2013

(54) TREATMENT SOLUTION FOR INSULATION COATING FOR GRAIN ORIENTED ELECTRICAL STEEL SHEET AND METHOD FOR PRODUCING GRAIN ORIENTED ELECTRICAL STEEL SHEET HAVING INSULATION COATING

(75) Inventors: Minoru Takashima, Okayama (JP); Mineo Muraki, Okayama (JP); Makoto Watanabe, Okayama (JP); Tomofumi Shigekuni, Okayama (JP)

(73) Assignee: JFE Steel Corporation (JP)

( * ) Notice: Subject to any disclaimer, the term of this patent is extended or adjusted under 35 U.S.C. 154(b) by 457 days.

(21) Appl. No.: 12/675,158

(22) PCT Filed: Aug. 28, 2008

(86) PCT No.: PCT/JP2008/065925

§ 371 (c)(1),
(2), (4) Date: Mar. 22, 2010

(87) PCT Pub. No.: WO2009/028726

PCT Pub. Date: Mar. 5, 2009

(65) Prior Publication Data

US 2010/0206437 A1 Aug. 19, 2010

(30) Foreign Application Priority Data

Aug. 30, 2007 (JP) ..... 2007-224742

(51) Int. Cl.
*C23C 22/07* (2006.01)
*C23C 22/00* (2006.01)

(52) U.S. Cl. ..... 148/262; 106/14.12; 148/247; 148/253; 148/263

(58) Field of Classification Search ..... 106/14.12; 148/247, 253, 262, 263
See application file for complete search history.

(56) References Cited

U.S. PATENT DOCUMENTS

| | | | |
|---|---|---|---|
| 3,856,568 | A | 12/1974 | Tanaka et al. |
| 3,985,583 | A | 10/1976 | Shimanaka et al. |
| 4,120,702 | A | 10/1978 | Akerblom |

FOREIGN PATENT DOCUMENTS

| | | | |
|---|---|---|---|
| JP | 48-039338 | A | 6/1973 |
| JP | 50-079442 | A | 6/1975 |
| JP | 57-009631 | B | 2/1982 |
| JP | 58-044744 | B | 10/1983 |
| JP | 4-165022 | A | 6/1992 |
| JP | 2002-047576 | A | 2/2002 |
| JP | 2005-240125 | A | 9/2005 |
| JP | 3-784400 | B1 | 6/2006 |
| JP | 2007-023329 | A | 2/2007 |
| WO | 2006/126560 | A1 | 11/2006 |

*Primary Examiner* — Lois Zheng
(74) *Attorney, Agent, or Firm* — DLA Piper LLP (US)

(57) ABSTRACT

A treatment solution for insulation coating for grain oriented electrical steel sheet includes at least one member selected from phosphates of Mg, Ca, Ba, Sr, Zn, Al, and Mn, and colloidal silica in a proportion of 0.2 to 10 mol in terms of $SiO_2$ and a titanium chelate compound in a proportion of 0.01 to 4.0 mol in terms of Ti, relative to $PO_4$: 1 mol in the phosphates.

9 Claims, 1 Drawing Sheet

TREATMENT SOLUTION FOR INSULATION COATING FOR GRAIN ORIENTED ELECTRICAL STEEL SHEET AND METHOD FOR PRODUCING GRAIN ORIENTED ELECTRICAL STEEL SHEET HAVING INSULATION COATING

RELATED APPLICATIONS

This is a §371 of International Application No. PCT/JP2008/065925, with an international filing date of Aug. 28, 2008 (WO 2009/028726 A1, published Mar. 5, 2009), which is based on Japanese Patent Application No. 2007-224742, filed Aug. 30, 2007, the subject matter of which is incorporated by reference.

TECHNICAL FIELD

This disclosure relates to a chromium-free treatment solution for insulation coating for grain oriented electrical steel sheet for use in production of a grain oriented electrical steel sheet having excellent tension induced by a coating, moisture-absorption resistance, rust resistance, and lamination factor. The disclosure also relates to a method for producing a grain oriented electrical steel sheet having an insulation coating using the chromium-free treatment solution for insulation coating for grain oriented electrical steel sheet.

BACKGROUND

In recent years, the noise from power transformers poses problems as environmental pollution. The noise of power transformers is mainly caused by magnetostriction of a grain oriented electrical steel sheet used as an iron core material of transformers. To reduce the noise of transformers, it is required to reduce the magnetostriction of the grain oriented electrical steel sheet. An industrially advantageous solution is to cover the grain oriented electrical steel sheet with an insulation coating.

As properties required for insulation coatings for grain oriented electrical steel sheets, tension induced by a coating, moisture-absorption resistance, rust resistance, and lamination factor are mentioned. Among the properties, securing the tension induced by a coating is important for the reduction in the magnetostriction. Here, the tension induced by a coating refers to tension given to grain oriented electrical steel sheets by the formation of insulation coatings.

The coatings of grain oriented electrical steel sheets generally contain a ceramic forsterite coating formed by secondary recrystallization annealing and a phosphate-based insulation coating provided thereon. As a method for forming the insulation coating, techniques disclosed in Japanese Unexamined Patent Application Publication Nos. 48-39338 and 50-79442 are known. In these techniques, a treatment solution for insulation coating containing colloidal silica, phosphates, and chromium compounds (e.g., one or two or more members selected from chromic anhydrides, chromates, and dichromates) is applied to a steel sheet, and then the steel sheet is baked.

The insulation coatings formed by these methods have effects of improving the magnetostriction properties by giving tensile stress to grain oriented electrical steel sheets. However, the treatment solutions for insulation coating contain chromium compounds, such as chromic anhydrides, chromates, or dichromates, as components for maintaining favorable moisture-absorption resistance of the insulation coating, resulting in the fact that the treatment solutions for insulation coating contain hexachromium derived from the chromium compounds. Japanese Unexamined Patent Application Publication No. 50-79442 also discloses a technique of adding no chromium compounds. However, the technique is extremely disadvantageous from the viewpoint of moisture-absorption resistance. The hexachromium contained in the treatment solution for insulation coating is reduced into trivalent chromium by baking to be detoxicated. However, there arise problems in that various difficulties occur in handling in waste liquid treatment of the treatment solution.

In contrast, as a so-called chromium-free treatment solution for insulation coating for grain oriented electrical steel sheet not substantially containing chromium, Japanese Examined Patent Application Publication No. 57-9631 discloses a treatment solution for insulation coating containing colloidal silica, aluminum phosphate, and boric acid, and further containing one or two or more members selected from sulfates of Mg, Al, Fe, Co, Ni, and Zn. Moreover, Japanese Examined Patent Application Publication No. 58-44744 also discloses a treatment solution for insulation coating containing colloidal silica and magnesium phosphate and further containing one or two or more members selected from sulfates of Mg, Al, Mn, and Zn. However, the use of the treatment solutions for insulation coating of Japanese Examined Patent Application Publication Nos. 57-9631 and 58-44744 has caused problems in terms of tension induced by a coating and moisture-absorption resistance in a request to coating properties in recent years.

As methods for solving the problems of lack of tension induced by a coating, moisture-absorption resistance lack, and the like occurring when the treatment solution for insulation coating is rendered chromium-free, Japanese Unexamined Patent Application Publication No. 2007-23329 discloses a chromium-free treatment solution for insulation coating containing a dispersion liquid of a colloidal compound containing (I) colloidal silica, (II) phosphate, and (III) one or two or more metal elements selected from Fe, Al, Ga, Ti, and Zr.

However, according to our study, when the treatment solution for insulation coating described in Japanese Unexamined Patent Application Publication No. 2007-23329 is used, there are problems in that a surface free from stickiness is obtained immediately after baking, but stickiness arises during prolonged storage, such as one month or two months, and the moisture-absorption resistance is still insufficient.

Our steels and methods have been developed in view of the above-described present circumstances, and aim to achieve each of the following items:

- preventing the reduction in tension induced by a coating and moisture-absorption resistance which poses a problem when a treatment solution for insulation coating is rendered chromium-free,
- providing a chromium-free treatment solution for insulation coating for grain oriented electrical steel sheet capable of providing a grain oriented electrical steel sheet having excellent insulation coating properties, i.e., excellent tension induced by a coating, moisture-absorption resistance, rust resistance, and lamination factor, and
- providing a method for producing a grain oriented electrical steel sheet having an insulation coating using the chromium-free treatment solution for insulation coating for grain oriented electrical steel sheet described above.

SUMMARY

We coat a grain oriented electrical steel sheet after secondary recrystallization annealing with a treatment solution for insulation coating containing various kinds of phosphates and colloidal silica and further containing various kinds of compounds, and thereafter baking the resultant. Then, the properties of the obtained coating were examined.

As a result, we found that insulation coatings having desired properties can be obtained by adding titanium chelate compounds. Furthermore, we have examined an optimal composition of the chromium-free treatment solution for insulation coating for grain oriented electrical steel sheets using various phosphates and titanium chelate compounds. We have also examined a method for producing a grain oriented electrical steel sheet having an insulation coating using the chromium-free treatment solution for insulation coating.

We thus provide:

(1) A treatment solution for insulation coating for grain oriented electrical steel sheet contains:

at least one member selected from phosphates of Mg, Ca, Ba, Sr, Zn, Al, and Mn; and colloidal silica in a proportion of 0.2 to 10 mol in terms of $SiO_2$ and a titanium chelate compound in a proportion of 0.01 to 4.0 mol in terms of Ti, relative to $PO_4$: 1 mol in the phosphate(s).

Preferably, the treatment solution for insulation coating is chromium-free, and, particularly preferably, the treatment solution for insulation coating does not substantially contain Cr. The treatment solution is preferably a water-based solution.

(2) A method for producing a grain oriented electrical steel sheet having an insulation coating includes a series of processes of forming a slab for grain oriented electrical steel sheet into a sheet having a final sheet thickness by rolling, subjecting the sheet to primary recrystallization annealing, then subjecting the sheet to secondary recrystallization annealing, applying a treatment solution for insulation coating to the sheet, and then baking the sheet, in which, as the treatment solution for insulation coating, a treatment solution for insulation coating is used which contains:

at least one member selected from phosphates of Mg, Ca, Ba, Sr, Zn, Al, and Mn; and colloidal silica in a proportion of 0.2 to 10 mol in terms of $SiO_2$ and a titanium chelate compound in a proportion of 0.01 to 4.0 mol in terms of Ti, relative to $PO_4$: 1 mol based on $PO_4$ in the phosphate(s), and the baking treatment is performed at a temperature of 350° C. or higher and 1100° C. or lower.

Preferably, the treatment solution for insulation coating is chromium-free and, particularly preferably, the treatment solution for insulation coating does not substantially contain Cr. The treatment solution is preferably a water-based solution.

As the rolling, it is preferable to achieve the final sheet thickness by performing cold rolling once, or twice or more including intermediate annealing, after performing hot rolling or further performing normalizing annealing. Furthermore, it is preferable to apply an annealing separator containing MgO as a primary component after the primary recrystallization annealing, and then perform the secondary recrystallization annealing.

DETAILED DESCRIPTION

Figure 1:
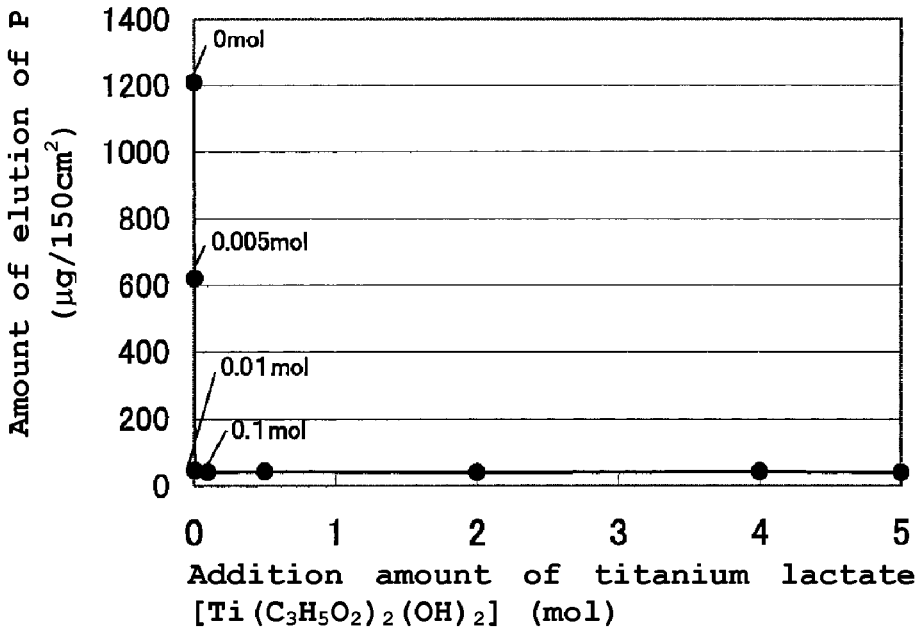
FIG. 1 shows effects of the addition amount of titanium lactate $[Ti(C_3H_5O_2)_2(OH)_2]$ (Axis of abscissa: Addition amount in terms of Ti relative to $PO_4$: 1 mol, Unit: mol) to a treatment solution for insulation coating on the moisture-absorption resistance of an insulation coating (Axis of ordinates: Amount of elution of P per 150 $cm^2$, Unit: μg).

Hereinafter, the experimental results forming the basis of the disclosure will be described.

First, treatment solutions for insulation coating were prepared by mixing the following compounds:

450 ml of a 24 mass % aqueous solution of magnesium phosphate $[Mg(H_2PO_4)_2]$ ($PO_4$: 1 mol), 450 ml of colloidal silica (water base) of $SiO_2$: 27 mass % ($SiO_2$: 2 mol), and titanium lactate $[Ti(C_3H_5O_2)_2(OH)_2]$ in a proportion of 0.005 to 5.0 mol in terms of Ti. For comparison, a treatment solution containing no titanium lactate was also prepared. The titanium lactate was supplied in a solid form, and was dissolved in the treatment solution. The treatment solutions were prepared such that the above mixing ratios were maintained and the amounts of the treatment solutions were sufficient for experiments below.

A grain oriented electrical steel sheet (sheet thickness: 0.22 mm) having a forsterite coating after subjected to the secondary recrystallization annealing was coated with the treatment solutions for insulation coating, and baked at 800° C. for 20 seconds, thereby forming an insulation coating so that the thickness per one side is 2 μm. The grain oriented electrical steel sheet thus obtained was evaluated for the tension induced by a coating, moisture-absorption resistance, rust resistance, and lamination factor by methods described below.

(1) Tension Induced by a Coating

Test pieces having a width of 30 mm and a length of 280 mm were extracted by shearing from the grain oriented electrical steel sheet having an insulation coating such a manner that the lengthwise direction was set to the rolling direction. Subsequently, the insulation coating on one of the both faces is removed. The dimension of the amount of curvature deformation of one end of the test pieces was measured while fixing one end having a length of 30 mm in the lengthwise direction of the steel sheet, and the tension induced by a coating σ was calculated from Equation (1). To eliminate the effects of the self weight of the steel sheet, the amount of curvature deformation was measured in such a manner that the lengthwise direction of the steel sheet was set to the horizontal direction and the width direction was set to the vertical direction, respectively.

$$\sigma\ (\text{MPa}) = 1.2152\times10^5\ (\text{MPa})\times\text{Sheet thickness (mm)}\times\text{Curvature deformation (mm)}/250\ (\text{mm})/250\ (\text{mm}) \qquad \text{Equation (1)}$$

(2) Moisture-Absorption Resistance

Three test pieces (50 mm×50 mm) were extracted from the grain oriented electrical steel sheet having an insulation coating, and dipped and boiled for 20 minutes in 100° C. distilled water. Then, the amount of P eluted from the coating surface (amount of elution of P) was quantitatively analyzed, and the average value was determined to be used as the index of the moisture-absorption resistance.

(3) Rust Resistance

The steel sheet having an insulation coating was held in the air having a temperature of 50° C. and a dew point of 50° C.

for 200 hours. Thereafter, the steel sheet surface was visually observed, and then, the area ratio of rust was measured.

(4) Lamination Factor

The lamination factor was evaluated by a method based on JIS C 2550.

Figure 2:
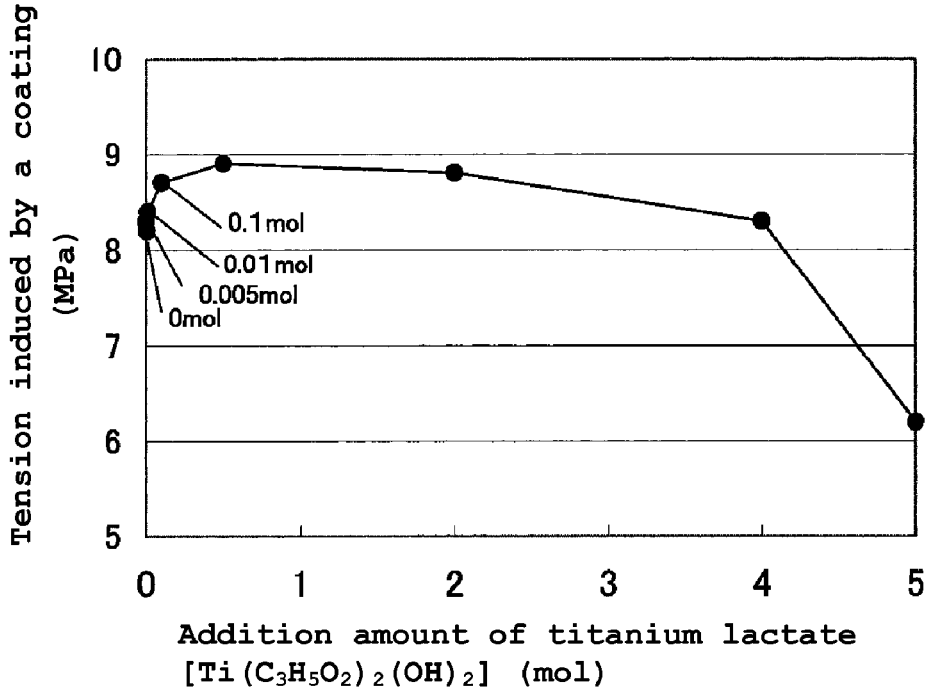
FIG. 2 shows effects of the addition amount of titanium lactate $[Ti(C_3H_5O_2)_2(OH)_2]$ (Axis of abscissa: Same as in FIG. 1) to a treatment solution for insulation coating on the tension induced by a coating of an insulation coating (Axis of ordinates, Unit: MPa).

The results are shown in FIGS. 1 and 2.

FIG. 1 shows effects of the addition amount of titanium lactate $[Ti(C_3H_5O_2)_2(OH)_2]$ (Axis of abscissa: Addition amount to $PO_4$: 1 mol) on the amount of elution of P, i.e., moisture-absorption resistance, of the insulation coating (Axis of ordinates: per 150 $cm^2$, Unit: μg). FIG. 2 shows effects of the addition amount of titanium lactate $[Ti(C_3H_5O_2)_2(OH)_2]$ (Axis of abscissa) on the tension induced by a coating of the insulation coating (Axis of ordinates, Unit: MPa). The addition amount of titanium lactate $[Ti(C_3H_5O_2)_2(OH)_2]$ in FIGS. 1 and 2 is the number of moles in terms of Ti.

When the addition amount of titanium lactate $[Ti(C_3H_5O_2)_2(OH)_2]$ reached 0.01 mol or more relative to $PO_4$: 1 mol, the moisture-absorption resistance remarkably improved and the improvement of the tension induced by a coating was also observed.

In contrast, when the addition amount exceeded 4.0 mol, the moisture-absorption resistance was satisfactory but the reduction in the tension induced by a coating was observed.

The rust resistance and the lamination factor were excellent when the addition amount of titanium lactate $[Ti(C_3H_5O_2)_2(OH)_2]$ was in the range of 0.005 to 5.0 mol in terms of Ti.

(Treatment Solution for Insulation Coating)

The treatment solution for insulation coating is preferably a water-based solution. More specifically, the treatment solution for insulation coating contains at least one member selected from phosphates of Mg, Ca, Ba, Sr, Zn, Al, and Mn, colloidal silica, and a titanium chelate compound, in which water is preferably used as a solvent.

First, as the phosphates, it is required to select one or two or more members from phosphates of Mg, Ca, Ba, Sr, Zn, Al, and Mn and blend the same in the treatment solution for insulation coating. This is because, in the case of phosphates other than the phosphates mentioned above, a coating having favorable moisture-absorption resistance is not obtained when adding no chromium compounds (e.g., chromates). In particular, $Mg(H_2PO_4)_2$, $Ca(H_2PO_4)_2$, $Ba(H_2PO_4)_2$, $Sr(H_2PO_4)_2$, $Zn(H_2PO_4)_2$, $Al(H_2PO_4)_3$, and $Mn(H_2PO_4)_2$, which are primary phosphates of Mg, Ca, Ba, Sr, Zn, Al, and Mn, easily dissolve in water, and thus can be preferably used. Moreover, hydrates of the primary phosphates are similarly preferable.

It is required to contain colloidal silica in a proportion of 0.2 to 10 mol in terms of $SiO_2$ relative to $PO_4$: 1 mol in the phosphates mentioned above. The colloidal silica forms a low thermal expansion compound with the phosphates mentioned above to produce tension induced by a coating, and thus is an essential component. To demonstrate the effects as mentioned, it is preferable that the proportion be 0.2 mol or more and 10 mol or less in terms of $SiO_2$ relative to $PO_4$: 1 mol in the phosphates mentioned above.

The type of colloidal silica is not limited insofar as the stability of the solution or the compatibility with the phosphates mentioned above or the like is obtained. For example, ST-O (manufactured by Nissan Chemical Industries, LTD., $SiO_2$ content: 20 mass %), which is a commercially available acid-type, is mentioned, and an alkaline-type colloidal silica can also be used.

Since the appearance of the insulation coating is improved, colloidal silica containing a sol containing aluminum (Al) can also be used. In this case, the Al amount is preferably 1.0 or lower relative to $Al_2O_3/SiO_2$ ratio.

It is particularly important for the treatment solution for insulation coating to contain a titanium chelate compound in a proportion of 0.01 to 4.0 mol in terms of Ti relative to $PO_4$: 1 mol in the phosphate so as to increase the moisture-absorption resistance. The titanium chelate compound refers to compounds in which ligands having a plurality of coordinates bond to a tetravalent and six-coordinate titanium atom, and compounds having a structure represented by Formula (2) are typically mentioned.

(Formula (2))

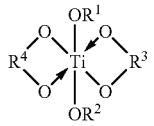

As such titanium chelate compounds, any titanium chelate compound can be advantageously applied insofar as sedimentation does not occur when blended in the treatment solution for insulation coating. Generally, in Formula (2), $R^1$ and $R^2$ each represent hydrogen or an organic group, $R^3$ and $R^4$ each are an organic group, and the number of carbons of each organic group is 10 or lower. Examples of preferable compounds are mentioned later.

To obtain favorable moisture-absorption resistance, it is required that the addition amount of the titanium chelate compound is 0.01 mol or more in terms of Ti relative to $PO_4$: 1 mol in the phosphates. In contrast, when the titanium chelate compound is added in a proportion exceeding 4.0 mol, the thermal expansion of a coating increases and the tension induced by a coating decreases. Thus, such a proportion is not preferable. A more preferable addition amount of the titanium chelate compound is 0.05 to 3.0 mol in terms of Ti.

The fact that the moisture-absorption resistance increases by the addition of the titanium chelate compound is considered to be based on the following reasons.

It is considered that, during the baking treatment, free state $PO_4$ in phosphate that was not incorporated in glass, formed from silica and the phosphate, combines with titanium in the titanium chelate compound to become insoluble in an insulation coating. Therefore, it is assumed that the moisture-absorption resistance increases. When organic compounds of Ca, Mg, Mn, Fe, Zn, Co, Ni, or Cu are added, the moisture-absorption resistance slightly increases. However, the effect of increasing the moisture-absorption resistance of the titanium chelate compound is markedly higher than that of organic compounds. This is because Ca, Mg, Mn, Fe, Zn, Co, Ni, and Cu are divalent or trivalent but Ti is tetravalent and has many bonds, and thus the bonding strength is strong.

The titanium chelate compound is a complex in which a chelate compound is coordinated to Ti, and any titanium chelate compound can be applied insofar as it can be blended without causing sedimentation in the treatment solution for insulation coating. For example, titanium di-iso-propoxy bis-(acetylacetonate)$[Ti(i\text{-}C_3H_7O)_2(C_5H_7O_2)_2]$, titanium tetra-acetyl acetonate$[Ti(C_5H_7O_2)_4]$, titanium lactate $[Ti(C_3H_5O_2)_2(OH)_2]$, and titanium di-iso-propoxy bis (triethanol aminato)$[(Ti(i\text{-}C_3H_7O)_2(C_6H_{14}O_3N)_2)]$ are mentioned. Among the above, titanium lactate having a relatively low molecular weight is particularly preferable.

The titanium compound generally has a high reactivity. However, the titanium chelate compound is a compound in which ligands having a plurality of coordinates bond to a titanium atom, and thus the titanium atom is inactivated. Therefore, in the treatment solution for insulation coating, the titanium chelate compound does not react with water, phosphate, and colloidal silica, and is extremely stable. Then, at the beginning stage of the baking treatment, i.e., until drying of a coating liquid is completed, hydrolysis hardly occurs and the titanium compound does not precipitate. Therefore, the titanium in the added titanium chelate compound combines with $PO_4$ and is surely baked into the insulation coating. More specifically, it is considered that the titanium in the applied titanium chelate does not precipitate and fall out due to a certain reaction during the baking treatment, and remains in the insulation coating until the baking treatment is completed. Thus, it is estimated that the coating composition becomes uniform and the moisture-absorption resistance and the rust resistance increase.

When not the titanium chelate compound but Ti-containing colloidal substances are used as the Ti compound, there is a disadvantage in that the surface free from stickiness is obtained immediately after baking, but the stickiness arises during prolonged storage, e.g., one month or two months. More specifically, the moisture-absorption resistance as favorable cannot be expected.

There is no need of limiting the concentration of the primary components mentioned above in the treatment solution for insulation coating. However, when the concentration is low, the insulation coating becomes thin. When the concentration is high, the viscosity of the treatment solution for insulation coating becomes high, resulting in the reduction in workability, such as application. Considering the above facts, it is preferable to adjust the amount of the phosphates mentioned above to be in the range of approximately 0.02 to 20 mol/l in terms of $PO_4$. The concentrations of the colloidal silica and the titanium chelate compound are naturally determined when the concentration of the phosphates are determined.

In addition to the above, the following substances may be added to the treatment solution for insulation coating.

First, to increase the heat resistance of the insulation coating, boric acid may be added.

To increase the sticking resistance or the slipping properties of grain oriented electrical steel sheets, one or two or more members selected from $SiO_2$, $Al_2O_3$, and $TiO_2$ having a primary particle diameter of 50 to 2000 nm or less may be blended in the treatment solution for insulation coating. The reasons for requiring the sticking resistance are as follows. When a grain oriented electrical steel sheet is used for a wound core type transformer, the steel sheet is rolled to be formed into an iron core, and then subjected to strain relief annealing (e.g., about 800° C.× about 3 hours). In that case, sticking between adjacent coatings sometimes arises. Such sticking reduces the insulation resistance between adjacent sheets of the iron core to thereby deteriorate the magnetic properties. Thus, it is preferable to give sticking resistance to the insulation coating. With respect to the slipping properties, when a grain oriented electrical steel sheet is used for a laminated core type transformer, it is preferable to improve slipping properties between steel sheets so as to smoothly perform stacking of the steel sheets.

In addition to the above substances, various additives that are sometimes used for the treatment solution for insulation coating can be added. It is preferable that the content of the boric acid, $SiO_2$, and the like and other additives be about 30 mass % or lower in total.

It is preferable that the treatment solution for insulation coating be chromium-free and is particularly preferable that the treatment solution for insulation coating does not substantially contain Cr. Here, "not substantially contain" means that Cr derived from impurities contained in the raw materials is permitted but Cr is not positively added. For example, components, such as the phosphates, colloidal silica, and titanium chelate compound, are almost available as commercially available items for industrial use in many cases. An amount of Cr as contained in these commercially available compounds as impurity is acceptable.

(Method for Producing Grain Oriented Electrical Steel Sheet)

Next, a method for producing a grain oriented electrical steel sheet having an insulation coating using the chromium-free treatment solution for insulation coating will be described.

A steel slab for grain oriented electrical steel sheet having a given chemical composition is rolled to achieve a final sheet thickness. Thereafter, primary recrystallization annealing and secondary recrystallization annealing are performed, and then the treatment solution for insulation coating described above is applied to the steel sheet surface. Subsequently, the steel sheet is baked at a temperature of 350 to 1100° C. In general, the slab for grain oriented electrical steel sheet is subjected to hot rolling, then subjected to normalizing annealing as required, and then subjected to cold rolling once, or twice or more including intermediate annealing, to thereby achieve the final sheet thickness.

The chemical composition of the slab is not limited, and any known chemical composition is accepted. The production method is also not limited, and any known production method can be used. For information, the primary components of a typical slab for grain oriented electrical steel sheet contain c: 0.10 mass % or less, Si: 2.0 to 4.5 mass %, and Mn: 0.01 to 1.0 mass %. In grain oriented electrical steel sheets, various inhibitors are usually used, and elements according to the inhibitors are added in addition to the primary components mentioned above. For example, as the inhibitors,

- when MnS is used, S: about 200 ppm (i.e., about 100 to 300 ppm: hereinafter ppm means mass ppm) can be added,
- when AlN is used, sol.Al: about 200 ppm (i.e., about 100 to 300 ppm) can be added, and
- when MnSe and Sb are used, Mn, Se (about 100 to 300 ppm), and Sb (about 0.01 to 0.2 mass %) can be added.

In the composition, S, Al, N, and Se are generally almost removed from the steel sheet in the secondary recrystallization annealing process to be reduced to the level of impurities.

To the hot rolling of the slab for grain oriented electrical steel sheet, known methods can be applied. The sheet thickness after hot rolling is preferably adjusted to be in the range of 1.5 to 3.0 mm. The hot-rolled sheet after hot rolling may be subjected to normalizing annealing depending on requirement of a further improvement of magnetic properties and the like.

Thereafter, the hot-rolled sheet subjected to hot rolling or further normalizing annealing is subjected to cold rolling to achieve a final sheet thickness. The cold rolling may be once, or the cold rolling may be twice or more including intermediate annealing performed between cold rollings.

The primary recrystallization annealing subsequent to the cold rolling is performed to accelerate the primary recrystallization, but may be performed together with decarburization by controlling the atmosphere or the like. The treatment conditions of the primary recrystallization annealing can be set according to the purpose or the like, and continuous annealing is preferably performed at a temperature of 800 to 950° C. for 10 to 600 seconds. During the primary recrystallization annealing or after the primary recrystallization annealing, nitriding treatment can also be performed using ammonia gas or the like.

A subsequent secondary recrystallization annealing is a process for preferentially growing crystal grains obtained by the primary recrystallization annealing (primary recrystallized grain) in a so-called Goss orientation, i.e., the crystal orientation in which the magnetic properties are excellent in the rolling direction, by the secondary recrystallization. The conditions of the secondary recrystallization annealing can be set according to the purpose or the like. The secondary recrystallization annealing is preferably performed at a temperature of 800 to 1250° C. for about 5 to 300 hours.

In general, after the primary recrystallization annealing, the steel sheet is coated with an annealing separator containing MgO as a primary component (i.e., sufficiently containing MgO), and then the secondary recrystallization annealing is performed, thereby producing a forsterite coating on the steel sheet.

Also, in recent years, to further reduce the iron loss of the grain oriented electrical steel sheet, it has been examined to perform insulation coating treatment in a state where the forsterite coating is not formed. When the forsterite coating is not formed, an annealing separator is not applied or an annealing separator not containing MgO as a primary component (e.g., alumina base or the like) is applied.

The chromium-free treatment solution for insulation coating can be applied irrespective of the presence of the forsterite coating.

The chromium-free treatment solution for insulation coating is applied to the grain oriented electrical steel sheet after the secondary recrystallization manufactured through a series of the processes described above, and then the steel sheet is baked.

The chromium-free treatment solution for insulation coating may be diluted by adding water or the like to adjust the density for improvement of coating properties. For application, known measures, such as a roll coater, can be used.

The baking temperature is preferably 750° C. or higher. This is because the tension induced by a coating arises by baking at 750° C. or higher. When the grain oriented electrical steel sheet is used for the iron core of a transformer, the baking temperature may be 350° C. or higher. This is because, in the production of the iron core, strain relief annealing is performed at a temperature of about 800° C. for about 3 hours in many cases, and in this case, the tension induced by a coating develops during the strain relief annealing.

In contrast, when the temperature exceeds 1100° C., the rust resistance deteriorates. Thus, the temperature is adjusted to be 1100° C. or lower. In considering the above facts, the maximum range of the baking temperature is 350° C. or more and 1100° C. or lower.

The thickness of the insulation coating is not limited and the thickness per one side is preferably in the range of 1 to 5 μm. The tension induced by a coating is proportional to the thickness of the coating. Thus, when the thickness thereof is lower than 1 μm, the tension induced by a coating may be insufficient depending on purposes. In contrast, when the thickness thereof exceeds 5 μm, the lamination factor sometimes decreases more than necessary. The thickness of the insulation coating can be adjusted to a target value by the concentration, the applying amount, the applying conditions (e.g., pressing conditions of a roll coater), etc., of the treatment solution for insulation coating.

EXAMPLES

Example 1

A slab for grain oriented electrical steel sheet containing C: 0.05 mass %, Si: 3 mass %, sol.Al: 0.02 mass %, Mn: 0.04 mass %, S: 0.02 mass %, and a balance of Fe and inevitable impurities was hot-rolled to form a hot-rolled sheet having a sheet thickness of 2.0 mm, and then the hot-rolled sheet was subjected to normalizing annealing at 1000° C. for 60 seconds. Thereafter, the hot-rolled sheet was subjected to a first cold rolling to have an intermediate sheet thickness of 1.5 mm, then subjected to intermediate annealing at 1100° C. for 60 seconds, and then subjected to a second cold rolling to form a cold-rolled sheet having a final sheet thickness of 0.22 mm. Next, the cold-rolled sheet was subjected to primary recrystallization annealing at 820° C. for 150 seconds with decarburization. Thereafter, an annealing separator (MgO slurry) was applied thereto, and then secondary recrystallization annealing was performed at 1200° C. for 15 hours, thereby obtaining grain oriented electrical steel sheets having a forsterite coating.

Next, treatment solutions for insulation coating in which 700 ml (containing 3 mol in terms of $SiO_2$) of colloidal silica (water base) and the titanium chelate compounds indicated in Table 1 in various proportions in the range of 0.005 to 5.0 mol in terms of Ti were blended in 500 ml of aqueous solution containing 1 mol of magnesium phosphate $Mg(H_2PO_4)_2$ in terms of $PO_4$ were prepared. As the amount of the treatment solution, sufficient amount required for the following experiments was prepared while maintaining the mixing ratio mentioned above. The same applies below. The treatment solutions for insulation coating was applied to the surface of the grain oriented electrical steel sheets, and the steel sheets were baked at 750° C. for 1 minute. The thickness of the coating was adjusted so that the thickness per one side was 2 μm.

As comparative examples, grain oriented electrical steel sheets having an insulation coating were similarly produced using a chromium-free treatment solution for insulation coating containing no titanium chelate compounds or a treatment solution for insulation coating containing, in place of the titanium chelate compound, any one of 1 mol (in terms of Mg) of magnesium sulfate heptahydrate, 0.3 mol (in terms of Ti) of titanium-oxide colloid (non-chelate Ti compound), and 1 mol (in terms of Cr) of chromic anhydride (chromium compound).

Furthermore, as a conventional example, a grain oriented electrical steel sheet having an insulation coating was produced using the treatment solution for insulation coating of the "Present invention 3" of Example 1 in Japanese Unexamined Patent Application Publication No. 2007-23329. The treatment solution for insulation coating contains a dispersion liquid of a colloidal compound containing, 50 ml (solid of 35 g) of 50% primary phosphate Al, 100 ml (solid of 23 g) of 20% colloidal silica, and Fe (equivalent to Fe: 1.2 g) (pH 1.0, average particle diameter: 12 nm, solid concentration in terms of $Fe_2O_3$: 7.5%).

The grain oriented electrical steel sheets having an insulation coating thus obtained were evaluated for the tension induced by a coating, moisture-absorption resistance, rust resistance, and lamination factor by the following methods.

(1) Tension Induced by a Coating

Test pieces having a width of 30 mm and a length of 280 mm were extracted by shearing from the grain oriented electrical steel sheet having an insulation coating while defining the lengthwise direction as the rolling direction, and, subsequently, the insulation coating on one of the both faces was removed. The dimension of the amount of curvature deformation of one end of the test pieces was measured while fixing one end having a length of 30 mm in the lengthwise direction of the steel sheet, and the tension induced by a coating σ was calculated from Equation (1). Here, the amount of curvature deformation was measured in such a manner that the lengthwise direction of the steel sheet was set to the horizontal direction and the width direction was set to the vertical direction, respectively.

$$\sigma\ (\text{MPa}) = 1.2152\times10^5\ (\text{MPa})\times\text{Sheet thickness (mm)}\times\text{Curvature deformation (mm)}/250\ (\text{mm})/250\ (\text{mm}) \quad \text{Equation (1)}$$

(2) Moisture-Absorption Resistance

Three test pieces (50 mm×50 mm) were extracted from the grain oriented electrical steel sheets having an insulation coating, and dipped and boiled for 20 minutes in 100° C. distilled water. Then, the amount of elution of P of the coating surface was quantitatively analyzed, and the average value was determined to be used as the index of the moisture-absorption resistance.

(3) Rust Resistance

The steel sheets having an insulation coating were held in the air having a temperature of 50° C. and a dew point of 50° C. for 200 hours. Thereafter, the steel sheet surface was visually observed, and the rust resistance was evaluated based on the area ratio of the rust.

(4) Lamination Factor

The lamination factor was evaluated by a method based on JIS C 2550.

The measurement results are shown in Table 1.

Example 2

A slab for grain oriented electrical steel sheet containing C: 0.03 mass %, Si: 3 mass %, Mn: 0.04 mass %, S: less than 0.01 mass %, Sb: 0.03 mass %, sol.Al: lower than 0.01 mass %, and a balance of Fe and inevitable impurities was hot-rolled to form a hot-rolled sheet having a sheet thickness of 2.5 mm, and then the hot-rolled sheet was subjected to normalizing annealing at 1050° C. for 60 seconds. Then, the hot-rolled sheet was subjected to cold rolling to form a cold-rolled sheet having a sheet thickness of 0.30 mm. Then, the cold-rolled sheet was subjected to primary recrystallization annealing at 900° C. for 30 seconds. Thereafter, an annealing separator (MgO slurry) was applied thereto, secondary recrystallization annealing was performed at 880° C. for 50 hours, and subsequently annealing was further performed at 1200° C. for 15 hours, thereby obtaining grain oriented electrical steel sheets having a forsterite coating.

Next, treatment solutions for insulation coating in which 1000 ml of colloidal silicas (water base) having various concentrations (containing 0.5 to 10 mol in terms of $SiO_2$) and 0.5 mol in terms of Ti of titanium lactate $[Ti(C_3H_5O_2)_2OH)_2]$ were blended in 500 ml of aqueous solutions of various phosphates indicated in Table 2 (containing 1 mol in terms of $PO_4$)

TABLE 1

| No. | Titanium chelate compound: Type | Titanium chelate compound: Chemical formula | Addition amount (mol in terms of Ti)*1 | Tension induced by a coating (MPa) | Moisture-absorption resistance*2 (μg/150 cm²) | Rust resistance (%)*3 | Lamination factor (%) | Remarks |
|---|---|---|---|---|---|---|---|---|
| 1 | Titanium Lactate | $Ti(C_3H_5O_2)_2(OH)_2$ | 0.005 | 8.13 | 580 | 0 | 97.8 | Comparative example |
| 2 | Titanium Lactate | $Ti(C_3H_5O_2)_2(OH)_2$ | 0.01 | 8.21 | 48 | 0 | 97.9 | Present invention |
| 3 | Titanium Lactate | $Ti(C_3H_5O_2)_2(OH)_2$ | 0.02 | 8.23 | 42 | 0 | 97.8 | Present invention |
| 4 | Titanium Lactate | $Ti(C_3H_5O_2)_2(OH)_2$ | 0.10 | 8.44 | 41 | 0 | 97.8 | Present invention |
| 5 | Titanium Lactate | $Ti(C_3H_5O_2)_2(OH)_2$ | 0.30 | 8.28 | 43 | 0 | 97.7 | Present invention |
| 6 | Titanium di-iso-propoxy bis-(acetylacetonate) | $Ti(i\text{-}C_3H_7O)_2(C_5H_7O_2)_2$ | 0.30 | 8.33 | 42 | 0 | 97.6 | Present invention |
| 7 | Titanium tetra-acetyl acetonate | $Ti(C_5H_7O_2)_4$ | 0.30 | 8.42 | 45 | 0 | 97.8 | Present invention |
| 8 | Titanium Lactate | $Ti(C_3H_5O_2)_2(OH)_2$ | 2.0 | 8.20 | 43 | 0 | 97.5 | Present invention |
| 9 | Titanium Lactate | $Ti(C_3H_5O_2)_2(OH)_2$ | 4.0 | 8.17 | 41 | 0 | 97.8 | Present invention |
| 10 | Titanium Lactate | $Ti(C_3H_5O_2)_2(OH)_2$ | 5.0 | 6.28 | 42 | 0 | 97.4 | Comparative example |
| 11 | None | — | 0 | 8.04 | 1190 | 70 | 97.9 | Comparative example |
| 12 | Magnesium sulfate•heptahydrate*4 | $MgSO_4 \cdot 7H_2O$ | 1.0 | 7.12 | 128 | 0 | 97.3 | Comparative example |
| 13 | Treatment solution of Patent Document 5*5 (Present invention 3 of Example 1) | | — | 7.28 | 259 | 20 | 97.5 | Comparative example |
| 14*6 | Titanium Lactate | $Ti(C_3H_5O_2)_2(OH)_2$ | 0.3 | 8.25 | 45 | 0 | 97.6 | Present invention |
| 15 | Titanium-oxide colloid*4 | $TiO_2$ | 0.3 | 7.95 | 213 | 50 | 97.4 | Comparative example |
| 16 | Chromic anhydride*4 | $CrO_3$ | 1.0 | 8.19 | 55 | 0 | 97.5 | Comparative example |

*1 Number of moles relative to $PO_4$: 1 mol (in terms of Ti, Mg, or Cr)

*2 Evaluated based on the P elution amount

*3 Evaluated based on the area ratio of a rust development portion

*4 Adding as an alternative of titanium chelate compound

*5 Dispersion liquid of colloidal compound containing 50 ml (solid of 35 g) of 50% aluminum phosphate, 100 ml (solid of 23 g) of 20% colloidal silica, and Fe (equivalent to Fe: 1.2 g) (pH 1.0, average particle diameter: 12 nm, solid concentration in terms of $Fe_2O_3$: 75%)

*6 Adding 0.1 mol of boric acid and 0.3 mol of $Al_2O_3$ to $PO_4$: 1 mol

As shown in Table 1, when the chromium-free treatment solutions for insulation coating to which the titanium chelate compound was added in the range of 0.01 to 4.0 mol in terms of Ti were used, insulation coatings that are all excellent in the coating properties of the tension induced by a coating, moisture-absorption resistance, rust resistance, and lamination factor were formed. The insulation coating properties of the examples were equal to or more than those of the Comparative Examples to which chromium compounds were added.

were prepared. Then, the treatment solutions was applied to the surface of the grain oriented electrical steel sheets, and the steel sheets were baked at 1030° C. for 60 seconds. The coating thickness after the baking treatment was adjusted so that the thickness per one side was 3 μm.

The grain oriented electrical steel sheets after the baking treatment were evaluated for the tension induced by a coating, moisture-absorption resistance, rust resistance, and lamination factor by the same methods as in Example 1.

The results are shown in Table 2.

TABLE 2

| No. | Phosphate type Substance name | Chemical formula | Colloidal silica content (mol in terms of $SiO_2$)*1 | Tension induced by a coating (MPa) | Moisture-absorption resistance*1 (μg/150 $cm^2$) | Rust resistance (%)*2 | Lamination factor (%) | Remarks |
|---|---|---|---|---|---|---|---|---|
| 1 | Magnesium primary phosphate•dihydrate | $Mg(H_2PO_4)_2 \cdot 2H_2O$ | 0.5 | 8.25 | 42 | 0 | 97.8 | Present invention |
| 2 | Magnesium primary phosphate•dihydrate | $Mg(H_2PO_4)_2 \cdot 2H_2O$ | 1.0 | 8.17 | 45 | 0 | 97.7 | Present invention |
| 3 | Magnesium primary phosphate•dihydrate | $Mg(H_2PO_4)_2 \cdot 2H_2O$ | 5.0 | 8.04 | 41 | 0 | 97.8 | Present invention |
| 4 | Magnesium primary phosphate•dihydrate | $Mg(H_2PO_4)_2 \cdot 2H_2O$ | 10.0 | 8.23 | 43 | 0 | 98.0 | Present invention |
| 5 | Calcium primary phosphate | $Ca(H_2PO_4)_2$ | 2.0 | 8.51 | 45 | 0 | 97.8 | Present invention |
| 6 | Barium primary phosphate | $Ba(H_2PO_4)_2$ | 2.0 | 8.25 | 45 | 0 | 97.8 | Present invention |
| 7 | Strontium primary phosphate | $Sr(H_2PO_4)_2$ | 2.0 | 8.38 | 51 | 0 | 97.6 | Present invention |
| 8 | Zinc primary phosphate | $Zn(H_2PO_4)_2$ | 2.0 | 8.15 | 55 | 0 | 97.6 | Present invention |
| 9 | Aluminum primary phosphate | $Al(H_2PO_4)_3$ | 2.0 | 8.10 | 42 | 0 | 97.8 | Present invention |
| 10 | Manganese primary phosphate | $Mn(H_2PO_4)_2$ | 2.0 | 8.26 | 51 | 0 | 97.6 | Present invention |
| 11*4 | Magnesium primary phosphate•dihydrate | $Mg(H_2PO_4)_2 \cdot 2H_2O$ | 1.0 | 8.33 | 50 | 0 | 97.7 | Comparative example |

*1Number of moles relative to $PO_4$: 1 mol
*2Evaluated based on the P elution amount
*3Evaluated based on the area ratio of a rust development portion
*4Adding chromium compound (chromic anhydride, ($CrO_3$, adding 1 mol to $PO_4$: 1 mol)) in place of titanium chelate compound As shown in Table 2, when the chromium-free treatment solutions for insulation coating for grain oriented electrical steel sheet in which a suitable amount of the titanium chelate compound was blended in substances containing a suitable amount of various phosphates and colloidal silica were used, the insulation coating properties of the tension induced by a coating, moisture-absorption resistance, rust resistance, and lamination factors were all excellent.

Example 3

A slab for grain oriented electrical steel sheet containing C: 0.03 mass %, Si: 3 mass %, Mn: 0.04 mass %, S: less than 0.01 mass %, Sb: 0.03 mass %, sol.Al: less than 0.01 mass %, and a balance of Fe and inevitable impurities was hot-rolled to form a hot-rolled sheet having a sheet thickness of 2.5 mm, and then the hot-rolled sheet was subjected to normalizing annealing at 1050° C. for 60 seconds. Then, the hot-rolled sheet was subjected to cold rolling to form a cold-rolled sheet having a sheet thickness of 0.30 mm. Then, the cold-rolled sheet was subjected to primary recrystallization annealing at 900° C. for 30 seconds. Thereafter, an annealing separator (MgO slurry) was applied thereto, secondary recrystallization annealing was performed at 880° C. for 50 hours, and subsequently annealing was further performed at 1200° C. for 15 hours, thereby obtaining grain oriented electrical steel sheets having a forsterite coating.

Next, 500 ml of a mixed aqueous solution in which 250 ml (0.5 mol in terms of $PO_4$) of aqueous magnesium phosphate [$Mg(H_2PO_4)_2$] solution and 250 ml (0.5 mol in terms of $PO_4$) of aqueous aluminum phosphate [$Al(H_2PO_4)_3$] solution were mixed so that 1 mol in total of $PO_4$ was contained was prepared. Treatment solutions for insulation coating in which 700 ml (3 mol in terms of $SiO_2$) of colloidal silica and 1.0 mol in terms of Ti of titanium lactate [$Ti(C_3H_5O_2)_2OH)_2$] were blended in the aqueous phosphate solution were prepared. Subsequently, the treatment solutions was applied to the surface of the grain oriented electrical steel sheets, and the steel sheets were baked at temperatures indicated in Table 3. The temperatures indicated in Table 3 were soaking temperatures, the baking time was 30 seconds, and the coating thickness after the baking treatment was adjusted so that the thickness per one side was 3.0 μm.

The grain oriented electrical steel sheets after the baking treatment were evaluated for the tension induced by a coating, moisture-absorption resistance, rust resistance, and lamination factor by the same methods as in Example 1. To examine the effects of strain relief annealing, the tension induced by a coating was also evaluated after strain relief annealing at 800° C. for 3 hours.

The results are shown in Table 3.

TABLE 3

| No. | Baking treatment temperature (° C.) | Tension induced by a coating before strain relief annealing (MPa) | Tension induced by a coating after strain relief annealing (MPa) | Moisture-absorption resistance*1 (μg/150 $cm^2$) | Rust resistance (%)*2 | Lamination factor (%) | Remarks |
|---|---|---|---|---|---|---|---|
| 1 | 300 | 0.20 | 8.23 | 410 | 0 | 97.8 | Comparative example |
| 2 | 350 | 0.29 | 8.27 | 49 | 0 | 97.7 | Present invention |
| 3 | 500 | 2.94 | 8.19 | 43 | 0 | 97.7 | Present invention |
| 4 | 750 | 8.00 | 8.23 | 42 | 0 | 97.8 | Present invention |
| 5 | 850 | 8.23 | 8.38 | 43 | 0 | 97.7 | Present invention |
| 6 | 900 | 8.62 | 8.72 | 42 | 0 | 97.9 | Present invention |

TABLE 3-continued

| No. | Baking treatment temperature (° C.) | Tension induced by a coating before strain relief annealing (MPa) | Tension induced by a coating after strain relief annealing (MPa) | Moisture-absorption resistance*1 (μg/150 cm$^2$) | Rust resistance (%)*2 | Lamination factor (%) | Remarks |
|---|---|---|---|---|---|---|---|
| 7 | 1000 | 9.02 | 9.21 | 45 | 0 | 98.0 | Present invention |
| 8 | 1100 | 9.10 | 9.31 | 43 | 0 | 97.8 | Present invention |
| 9 | 1150 | 0.29 | 0.20 | 43 | 80 | 97.7 | Comparative example |

*1Evaluated based on the P elution amount

*2Evaluated based on the area ratio of a rust development portion

As shown in Table 3, when the temperature of the baking treatment is in the range of 350 to 1100° C., the properties of the tension induced by a coating after strain relief annealing, moisture-absorption resistance, rust resistance, and lamination factor were all excellent.

INDUSTRIAL APPLICABILITY

An insulation coating that are all excellent in the tension induced by a coating, moisture-absorption resistance, rust resistance, and lamination factor can be formed on the surface of a grain oriented electrical steel sheet, and thus the reduction in the magnetostriction of the grain oriented electrical steel sheet and further, the reduction in noise can be achieved.

Moreover, since the chromium-free treatment solution for insulation coating for grain oriented electrical steel sheet does not contain chromium compounds, the treatment solution is also preferable from the viewpoint of ease of waste liquid treatment and environmental protection. Moreover, the chromium-free treatment solution for insulation coating for grain oriented electrical steel sheet allows production of a grain oriented electrical steel sheet having an insulation coating outstanding coating properties, which are equivalent to those obtained when treatment solutions for insulation coating containing chromium compounds are used.

The invention claimed is:

1. A treatment solution for insulation coating for grain oriented electrical steel sheet, comprising:

at least one member selected from phosphates of Mg, Ca, Ba, Sr, Zn, Al, and Mn; and colloidal silica in a proportion of 0.2 to 10 mol in terms of $SiO_2$ and a titanium chelate compound in a proportion of 0.01 to 4.0 mol in terms of Ti, relative to $PO_4$:1 mol in the phosphates.

2. The treatment solution according to claim 1, not substantially comprising Cr.

3. A method for producing a grain oriented electrical steel sheet having an insulation coating, comprising a series of steps of:

forming a slab for grain oriented electrical steel sheet into a sheet having a final sheet thickness by rolling, subjecting the sheet to primary recrystallization annealing, subjecting the sheet to secondary recrystallization annealing, applying a treatment solution for insulation coating to the sheet, and baking the sheet, wherein the treatment solution for insulation coating contains at least one member selected from phosphates of Mg, Ca, Ba, Sr, Zn, Al, and Mn, colloidal silica in a proportion of 0.2 to 10 mol in terms of $SiO_2$ relative to $PO_4$:1 mol in the phosphates being used, and a titanium chelate compound in a proportion of 0.01 to 4.0 mol in terms of Ti, relative to $PO_4$:1 mol in the phosphates being used, and the baking step being performed at a temperature of 350° C. or higher and 1100° C. or lower.

4. The method according to claim 3, wherein the treatment solution for insulation coating does not substantially contain Cr.

5. The method according to claim 4, comprising:

forming the slab for grain oriented electrical steel sheet into a sheet having a final sheet thickness by performing cold rolling once, or twice or more including intermediate annealing, after performing hot rolling or further performing normalizing annealing.

6. The method according to claim 4, comprising:

performing the primary recrystallization annealing, applying an annealing separator containing MgO as a primary component, and performing the secondary recrystallization annealing.

7. The method according to claim 3, comprising:

forming the slab for grain oriented electrical steel sheet into a sheet having a final sheet thickness by performing cold rolling once, or twice or more including intermediate annealing, after performing hot rolling or further performing normalizing annealing.

8. The method for producing a grain oriented electrical steel sheet according to claim 7, comprising:

performing the primary recrystallization annealing, then applying an annealing separator containing MgO as a primary component, and then performing the secondary recrystallization annealing.

9. The method according to claim 3, comprising:

performing the primary recrystallization annealing, applying an annealing separator containing MgO as a primary component, and performing the secondary recrystallization annealing.

* * * * *